US008074402B2

(12) United States Patent
Tuller

(10) Patent No.: US 8,074,402 B2
(45) Date of Patent: Dec. 13, 2011

(54) FRICTIONAL DROP RESISTANCE FOR SASH COUNTERBALANCED BY CURL SPRINGS

(75) Inventor: Jeffrey Tuller, Rochester, NY (US)

(73) Assignee: Caldwell Manufacturing Company North America LLC, Rochester, NY (US)

( * ) Notice: Subject to any disclaimer, the term of this patent is extended or adjusted under 35 U.S.C. 154(b) by 164 days.

(21) Appl. No.: 12/106,541

(22) Filed: Apr. 21, 2008

(65) Prior Publication Data

US 2009/0260295 A1 Oct. 22, 2009

(51) Int. Cl.
*E05F 3/00* (2006.01)

(52) U.S. Cl. ..... 49/445; 49/447; 16/193; 16/197; 16/198; 16/199; 16/401

(58) Field of Classification Search ..... 16/193, 16/197, 198, 199, 400, 401; 49/445, 447
See application file for complete search history.

(56) References Cited

U.S. PATENT DOCUMENTS

| | | | | |
|---|---|---|---|---|
| 2,644,193 | A * | 7/1953 | Anderberg | 16/197 |
| 3,150,420 | A * | 9/1964 | Brenner | 49/445 |
| 5,353,548 | A | 10/1994 | Westfall | |
| 5,365,638 | A | 11/1994 | Braid et al. | |
| 5,463,793 | A | 11/1995 | Westfall | |
| 6,584,644 | B2 | 7/2003 | Braid et al. | |
| 6,598,264 | B2 | 7/2003 | Newman | |
| 6,679,000 | B2 | 1/2004 | Uken et al. | |
| 6,820,368 | B2 | 11/2004 | Uken et al. | |
| 6,983,513 | B2 * | 1/2006 | Pettit | 16/197 |
| 7,076,835 | B2 * | 7/2006 | Harold et al. | 16/197 |
| 7,587,787 | B2 * | 9/2009 | Pettit | 16/197 |

* cited by examiner

*Primary Examiner* — Jerry Redman
(74) *Attorney, Agent, or Firm* — Harness, Dickey & Pierce, P.L.C.

(57) ABSTRACT

Window sash counterbalances using curl springs and holders can increase resistance to sash drop without causing sash hop by using a high coefficient of friction bearing surfaces against which curled up coils of curl springs slide when uncurling or re-curling. The higher friction bearing material produces more frictional resistance to spring uncurling than to spring re-curling and thus resists drop without causing hop. This allows a wider range of sash weights to be counterbalanced by a fewer number of counterbalance forces, saves manufacturing cost.

19 Claims, 2 Drawing Sheets

FRICTIONAL DROP RESISTANCE FOR SASH COUNTERBALANCED BY CURL SPRINGS

FIELD OF THE INVENTION

Counterbalance systems for window sash.

BACKGROUND

Window sash have been counterbalanced by curl springs, as explained in U.S. Pat. No. 5,353,548 to Westfall; U.S. Pat. No. 5,463,793 to Westfall, and pending U.S. application Ser. No. 11/668,112 to Tuller. The invention of this application improves on such prior art suggestions.

The counterbalancing of window sash generally requires that counterbalance force approximates sash weight. Otherwise, an overbalanced sash tends to "hop" or rise upward from an intended position, and an under balanced sash tends to "drop" or fall downward from an intended open position. Avoiding hop and drop requires manufacturers to offer counterbalance systems in a range of forces suited to a widely varying weight range of window sash. The correspondingly wide range of forces required for counterbalance systems adds to manufacturing expense.

SUMMARY OF THE INVENTION

This invention aims at reducing the number of different counterbalance forces required to balance a range of sash weights, and thereby to reduce the cost of offering products suitable for counterbalancing the many different weights of window sash. The invention accomplishes this by exploiting a characteristic of curl spring mounts. These are molded of resin material to include a bearing surface against which curled up coils of curl springs slide as the springs uncurl or re-curl. The moving contact between the bearing surface and the curled up coils produces friction that differs slightly between uncurling and re-curling motion.

When a sash is rising and curl springs are re-curling, the lifting effect makes the curled up coils press more lightly against the bearing surfaces, which somewhat reduces the friction of the spring coils sliding against the bearing surfaces. Conversely, when a sash is lowering and the curl springs are uncoiling, the downward effect makes the curled up coils slightly press more firmly against the bearing surfaces, which increases the friction caused by the spring coil sliding against the bearing surfaces. This makes the frictional resistance of the coils sliding against bearing surfaces a little stronger for uncurling motion than for re-curling motion.

The invention exploits this phenomenon by giving the bearing surface of the holder a higher coefficient of friction than the resin typically used in forming the rest of the holder. This accentuates the frictional difference between uncurling and re-curling, which effectively increases the resistance to uncurling the curl springs without significantly increasing the resistance to re-curling the curl springs. Making the bearing surfaces more frictionally resistant to sliding motion of the curl spring coils, as they uncurl and re-curl, thus reduces a tendency of a sash to drop, without causing the sash to hop. With high frictional bearing surfaces deployed in curl spring holders, a balance system producing a single counterbalance force can effectively counterbalance a wider range of sash weights without causing either hop or drop. This, in turn, reduces the number of different counterbalance forces needed to accommodate a range of sash weights, which reduces manufacturing costs.

DRAWINGS

DETAILED DESCRIPTION

The embodiments of FIGS. 1-5 show curl spring holders adapted to engage and move up and down with a sash. Curled up coils 10 of curl springs 15 extend upward from holders 20 or 30 to a fixed position (not shown) above the course of travel of the holders. Curl springs 10 thus uncurl as a sash moves downward and re-curl as a sash moves upward.

Figure 6:
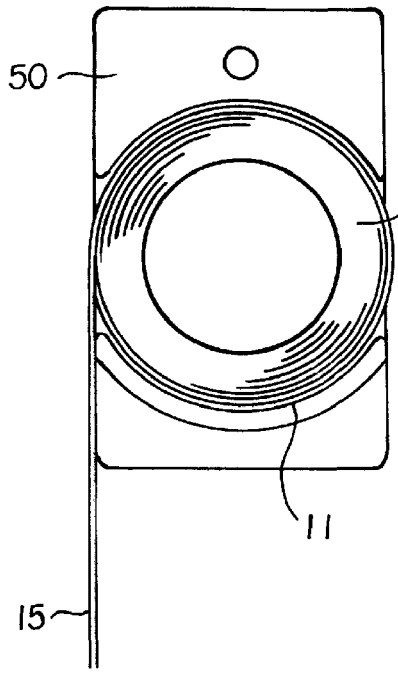
FIG. 6 is a partially schematic view of a holder and curl spring intended to be fixed in a window.
Figure 7:
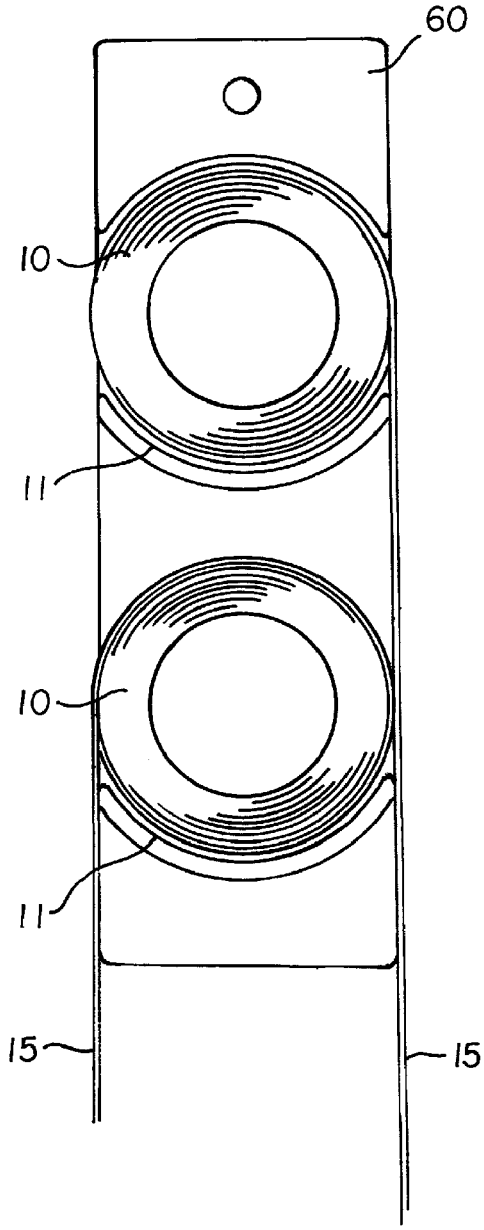
FIG. 7 is a schematic view of a double curl spring and holder arrangement to be fixed in a window.

The embodiment of FIGS. 6 and 7 shows curl spring coils 10 mounted in holders 50 or 60 that are fixed above sash travel so that uncurled spring lengths 15 extend downward to engage a carrier (not shown) that moves up and down with a sash. In this case also, springs 15 uncoil as a sash moves downward and recoil as a sash moves upward.

In all the illustrated curl spring and holder embodiments, curled up spring coils 10 rest against and are supported by holder bearing surfaces 11 against which coils 10 slide as springs 15 uncurl and re-curl. Upward movement of the sash slightly reduces the pressure of spring coils 10 against bearing surfaces 11, and downward movement of the sash slightly increases the pressure of spring coils 10 against bearing surfaces 11.

As uncurling and re-curling of springs 15 occurs, the diameter of curled up coils 10 respectively diminishes and increases so that the engagement of an outermost surface of coil 10 against bearing surface 11 is variable. Surface 11 is preferably arched, however, in a curvature having a somewhat longer radius than the maximum radius of curvature of a re-curled spring coil 10.

Holders 20, 30, 50, and 60 are preferably molded of resin material, and for this purpose, many different resins are available. Considering strength, durability, and economy, a coefficient of friction of the resin material forming the holders preferably ranges from 0.20 to 0.25.

To increase the frictional resistance of uncurling of springs 15, bearing surfaces 11 are preferably formed of a higher coefficient of friction material in the range of 0.30 to 0.55. This especially increases the resistance to uncurling of springs 15, which thereby resists sash drop.

With a high coefficient of friction material deployed for bearing surfaces 11, the frictional resistance to raising a sash increases only slightly, while the frictional resistance to lowering a sash increases significantly. The sash continues to be easy to raise, but it encounters more friction resisting downward movement. In other words, the balance system with high coefficient of friction bearing surfaces 11 has greater resistance to drop, without causing hop.

It follows that a curl spring balance system using one pair, two pair, or more curl springs can be given a predetermined counterbalance force that will be satisfactory for a wider range of sash weights because a lighter weight sash will not hop, and a heavier weight sash will not drop. This reduces the number of different counterbalance forces that a manufacturer needs to offer to counterbalance lighter and heavier sash. This in turn saves manufacturing expense.

Figure 1:
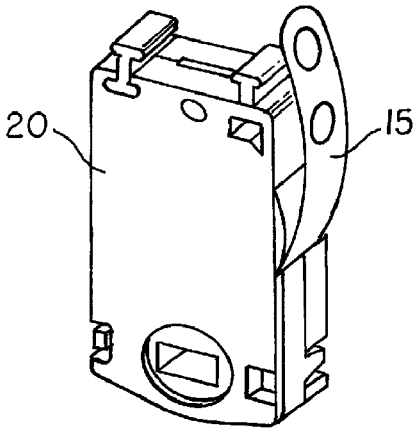
FIG. 1 is a holder and curl spring assembly disposed to ride up and down with a sash.
Figure 2:
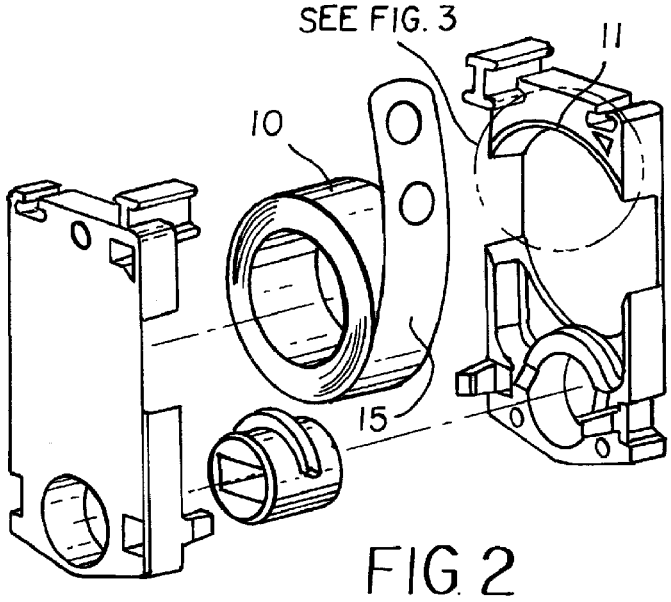
FIG. 2 is an exploded isometric view of the curl spring and holder of FIG. 1.
Figure 3:
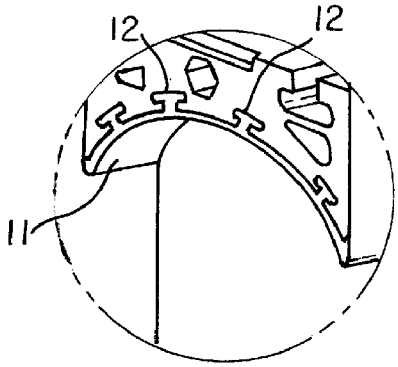
FIG. 3 is an enlarged fragment of the holder of FIG. 2.

The embodiment of FIGS. 1-3 shows high friction material bearing surface 11 molded in place in holder 20 so that frictional material 11 becomes a permanent part of shoe 20. Interlock elements 12 are preferably formed in holder 20 to be filled by high friction bearing surface material 11 to ensure that material 11 stays durably in place in holder 20. Interlock configurations suitable for this can have many different shapes.

Figure 4:
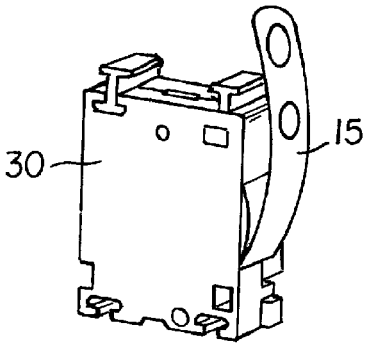
FIG. 4 is a view of another curl spring and holder attachable to the holder of FIGS. 1 and 2.
Figure 5:
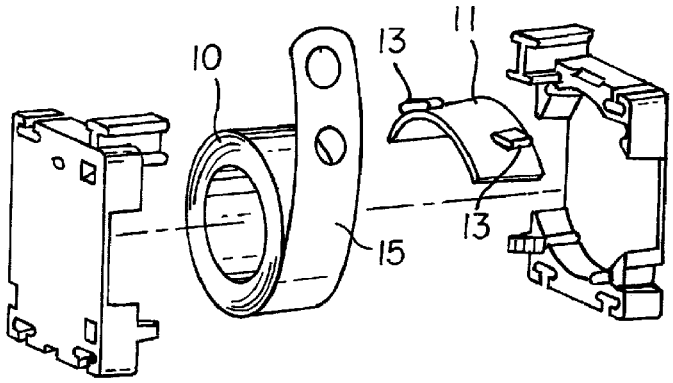
FIG. 5 is an exploded isometric view of the curl spring and holder of FIG. 4.

The embodiment of FIGS. 4 and 5 is adapted to run in tandem with the embodiment of FIGS. 1 and 2, to add an additional curl spring 15, which additionally contributes to counterbalance force. The tandem embodiment illustrates an alternative of high friction bearing material 11 being separately molded to be insertable into and removable from holder 30. This can allow bearing surfaces formed of different high coefficients of friction material so that a holder 30 can be adjusted for drop resistance by selecting and inserting a bearing surface 11 having the desired coefficient of friction. Whether the bearing surface is permanently formed in a holder, as shown in FIGS. 2 and 3, or is removably positioned within the holder, as shown in FIG. 5, is determined by a balance of factors including expense and demand.

When a high friction bearing surface material 11 is formed for removable insertion into holder 30, as shown in FIG. 5, interlocks 13 are preferably configured to facilitate quick and convenient insertion into holder 30. Suitable interlocks can be configured in many ways, with ease of insertion being one of the factors considered.

The embodiments of FIGS. 6 and 7 schematically show the potential simplicity of a fixed curl spring holder. These embodiments also can take advantage of permanent or removable bearing surfaces 11. Each holder can accommodate a single spring, such as illustrated in FIG. 6, or multiple springs, two of which are illustrated in FIG. 7. Preferably a high friction bearing surface 11 is arranged to engage each spring held by a holder.

The embodiments illustrated in FIGS. 1-5 include many details that can be varied in practicing the invention. The embodiments of FIGS. 6 and 7 illustrate not only a fixed type of curl spring holder, but also show that curl spring holders can be formed as simple structures. Any one of the many variations possible for fixed and movable spring holders can include a high coefficient of friction bearing material producing the advantages derivable from the claimed invention.

What is claimed is:

1. A combination of a curl spring and a holder used in a window sash counterbalance system, the holder comprising:

a holder body being formed of a first material having a first coefficient of friction to hold curled coils of the curl spring and permit uncurled lengths of the curl spring to pass out of and into the holder; and a bearing surface of the holder engaged by the curled coils of the curl spring substantially when a sash is lowered thereby uncurling the curl spring, the bearing surface being formed of a frictional material having a second coefficient of friction greater than the first coefficient of friction and within a range of about 0.30 to about 0.55;

wherein at least a portion of the uncurled length of the curl spring can engage the first material of the holder when passing into the holder with a first frictional resistance and wherein the bearing surface provides a second frictional resistance, based on the second coefficient of friction and greater than the first frictional resistance of the holder body, to an uncurling of the curl spring when the at least a portion of the uncurled length of the curl spring is passing out of the holder and thereby resists sash drop.

2. The combination of claim 1 wherein the frictional material is permanently formed in the holder.

3. The combination of claim 1 wherein the frictional material is formed as a bearing surface member holding the bearing surface and operable to be separately inserted into the holder.

4. A method of reducing the tendency of a counterbalanced sash to drop when the sash is counterbalanced by a curl spring, the method comprising:

forming a holder engaging the curl spring with a bearing surface when the curl spring is uncurled due to lowering of the sash, the bearing surface being formed of a frictional material having a selected coefficient of friction;

selecting a bearing surface from one of a plurality of bearing surfaces each formed of a different frictional material with different coefficients of friction, wherein each of the plurality of bearing surfaces is insertable into the holder to create different resistances to uncurling of the curl spring; and positioning the curl spring to engage with the frictional material of the bearing surface so that the bearing surface provides frictional resistance against uncurling of the curl spring, and thereby resists sash drop.

5. The method of claim 4 further comprising:

forming a bearing member including at least one of the plurality of the bearing surfaces separate from the holder and inserting the bearing member into the holder.

6. The method of claim 5, wherein forming a bearing member including at least one of plurality of the bearing surfaces further includes forming a plurality of bearing members each including a different one of the plurality of bearing surfaces; and selecting one of the plurality of bearing members having bearing surfaces each of frictional material with different coefficients of friction that are insertable into the holders to create different resistances to uncurling of the curl springs.

7. A method of counterbalancing window sashes in a weight range of heavy sash weights to light sash weights with a curl spring assembly having a single counterbalancing force, the method comprising:

moving a curl spring in a holder having the single counter balancing force;

selecting a bearing surface from a plurality of bearing surfaces each having different coefficients of friction, wherein each of the plurality of bearing surfaces is insertable into the holder to create different resistances to uncoiling of the curl spring; and engaging curled coils of the curl springs of the assembly with a bearing surface while uncurling the curl spring during lowering of a window sash in the weight range to increase resistance to uncoiling of the curl springs, wherein the bearing surface is selected to have a coefficient of friction so that the curl spring assembly avoids drop of the heavier sash in the range without causing hop of the lighter sash in the range.

8. The method of claim 7 further comprising:

making the bearing surface separate from and insertable into the holder for the curl springs.

9. A combination of a curl spring, a curl spring holder used in a window sash counterbalance system, comprising:

a window sash having a mass and moveable between a lowered position and a raised position;

a curl spring having a single counterbalancing force; and a curl spring holder including:

a body being formed of a material having a first coefficient of friction to hold curled coils of the curl spring and permit uncurled lengths of the curl spring to pass out of the curl spring holder, and a bearing surface inserted into the body, the bearing surface selected from a plurality of bearing surfaces each formed of a different frictional material with a different coefficient of friction, wherein the bearing surface is operable to be engaged by the curled coils of the curl spring with a second force greater than the counterbalancing force when the window sash is moving to the lowered position, wherein the curl spring is uncurled when the window sash is lowered;

wherein the bearing surface is formed of a frictional material having a second coefficient of friction greater than the first coefficient of friction so that the bearing surface provides frictional resistance to uncurling of the curl spring and thereby resists drop of the window sash.

10. The combination of claim 9, further comprising:

a bearing member that defines the bearing surface.

11. The combination of claim 10, wherein the bearing member is formed of a resin.

12. The combination of claim 11, wherein the bearing member is formed separate from the body and is insertable into the body.

13. The combination of claim 11, wherein the bearing member is molded into the body.

14. The combination of claim 11, wherein the first coefficient of friction of the first the material of the body is in a range from about 0.20 to about 0.25.

15. The combination of claim 10, wherein the bearing surface is positioned in the body such that the curl spring has a greater pressure against the bearing surface when the window sash is being lowered than when the window sash is being raised.

16. The combination of claim 9, wherein the second coefficient of friction is within a range of 0.30 to 0.55.

17. A combination of a curl spring and a holder used in a window sash counterbalance system, the holder comprising:

a holder body being formed of a first material having a first coefficient of friction to hold curled coils of the curl spring and permit uncurled lengths of the curl spring to pass out of and into the holder; and at least one bearing surface of the holder engaged by the curled coils of the curl spring substantially when a sash is lowered thereby uncurling the curl spring, the at least one bearing surface resulting in a second coefficient of friction within a range of about 0.30 to about 0.55;

wherein the uncurled coils of the curl spring can engage the first material of the holder when passing into the holder with a first frictional resistance based on the first coefficient of friction and the at least one bearing surface provides a second frictional resistance to an uncurling of the curl spring based on the second coefficient of friction when the coils of the curl spring are passing out of the holder and thereby resists sash drop.

18. The combination of claim 17 wherein the at least one bearing surface is formed of a frictional material that is permanently formed in the holder.

19. The combination of claim 18 wherein the frictional material is formed as a bearing surface member holding the bearing surface and operable to be separately inserted into the holder.

* * * * *